United States Patent [19]

Lipps

[11] 4,025,076

[45] May 24, 1977

[54] GEOMETRIC GAME PIECES

[76] Inventor: Edwin A. Lipps, 205 Chautauqua Ave., Pacific Palisades, Calif. 90272

[22] Filed: Aug. 13, 1975

[21] Appl. No.: 604,250

Related U.S. Application Data

[63] Continuation-in-part of Ser. No. 481,305, June 20, 1974, abandoned.

[52] U.S. Cl. ..... 273/137 R; 273/137 AE; 273/DIG. 25

[51] Int. Cl.² ..... A63F 3/00

[58] Field of Search ..... 273/130 R, 130 A, 130 F, 273/131 D, 136 B, 137 R, 137 AE, 137 C, 137 D, 153 R, 156, 157 R, DIG. 25

[56] References Cited

UNITED STATES PATENTS

| | | | |
|---|---|---|---|
| 1,354,910 | 10/1920 | Ketchum | 273/130 E UX |
| 2,002,077 | 5/1935 | Darling et al. | 273/157 R |
| 2,244,553 | 6/1941 | Ennis | 273/1 R |
| 2,472,439 | 6/1949 | Rogers | 273/137 R |
| 2,571,195 | 10/1951 | Buck | 273/137 R |
| 3,189,350 | 6/1965 | Hopkins | 273/153 R |
| 3,472,514 | 10/1969 | Green | 273/137 R X |
| 3,638,947 | 2/1972 | Hardesty | 273/137 D X |

FOREIGN PATENTS OR APPLICATIONS

| | | | |
|---|---|---|---|
| 112,723 | 1/1918 | United Kingdom | 273/137 D |
| 512,541 | 9/1939 | United Kingdom | 273/137 R |

*Primary Examiner*—Anton O. Oechsle
*Attorney, Agent, or Firm*—Lawrence Fleming

[57] ABSTRACT

A set of hexagonal or triangular pieces adapted to the playing of variants of the game of Go on a plain unmarked surface, by laying pieces down contiguously. Each piece has means for picking it up when it is surrounded by other pieces, as by having a central hole into which the stick-like handle may be temporarily inserted. Dual pieces, each shaped as two single pieces of opposite colors joined together along a common side, are also provided.

2 Claims, 9 Drawing Figures

GEOMETRIC GAME PIECES

REFERENCE TO RELATED APPLICATION

This application is a continuation-in-part of my prior application, Ser. No. 481,305, filed June 20, 1974, and now abandoned.

BACKGROUND

Table and board games, such as chess, checkers, dominoes, and Go, are of considerable antiquity. Game sets consisting of marked boards and movable pieces have been found in Ancient Egyptian tombs. Many new such games are devised which use sets of apparatus more complicated than those of the old games. It appears more generally desirable, however, to provide a new apparatus which is simpler than the old, so that the player is not distracted by the complexity of the equipment, but rather is free to concentrate on the essence of the game.

BRIEF SUMMARY

This invention provides a supply of hexagonal or triangular pieces of a size convenient for handling in the manner of Go stones or checkers, divided into two groups of contrasting colors, such as black and white, or otherwise distinguished. The pieces are adapted primarily to play a variant of the two-player game of Go-Bang or Japanese checkers. No board is required with the pieces of the invention; any plain surface will do. The rules are simple. The players lay pieces down alternately as in Go. Each piece must be laid down, or played, with one of its sides contiguous to a side (any side) of some other (any other) piece already played. The object is to get five pieces in a row. The first player to achieve this wins. The row may extend in any of three directions which lie at 120° angles to one another.

A convenient supply of pieces is 25 of each color. If neither player has got five pieces in a row when all these pieces have been played, the game may continue by each player taking up pieces already played and playing them in new positions.

Since a piece is not readily picked up by hand when it is surrounded contiguously by other pieces, the invention provides novel mechanical pick-up means. This may comprise a hole in the center of each piece. With large pieces, the hole may be finger-size; with smaller pieces, a stick-like handle is provided which is pushed temporarily into a hole. Other kinds of pick-up elements, such as suction cups or magnets, may be used.

In another modification, each piece is in the form of two hexagonal or triangular pieces of opposite colors (e.g., one black and one white) joined permanently together along a common side, i.e., a dual piece. Here, each play consists in a player playing, in effect, one piece of his own color and one of his opponent's color. The object, to get five pieces of one's own color in a row, remains the same.

Figure 1:
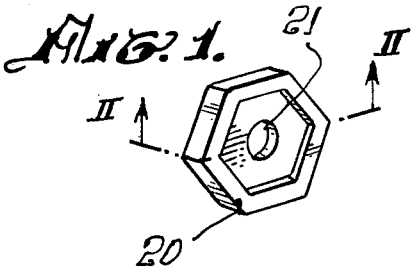
FIG. 1 is a perspective view of a hexagonal game piece according to the invention.
Figure 2:
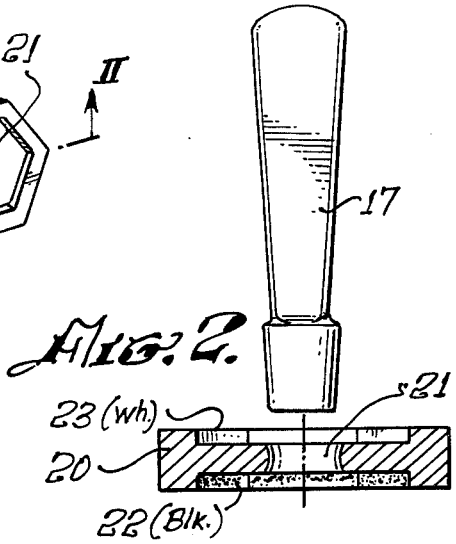
FIG. 2 is a section on line II—II of FIG. 1, also showing a handle.

In FIG. 1, the hexagonal game piece 20 has a central hole 21. Actually, it is shaped generally as a short hexagonal prism. In the section of FIG. 2, a handle 17 is shown which may be inserted into the hole 21 to pick up the piece 20. The piece 20 may be thinner in the central portion than at the rim portion, as shown. The opposite sides may be differently colored, e.g., side 23 white and side 22 black, so that all the pieces of an entire game set may be identical.

Figure 4:
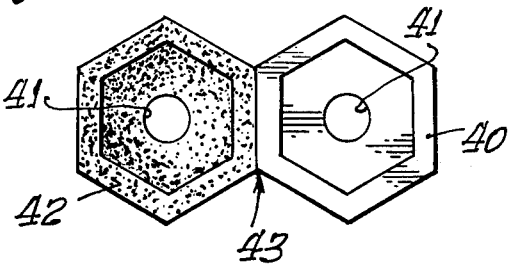
FIG. 4 is a top view of a dual piece.

FIG. 4 shows a dual piece, which may be made of two hexagonal pieces such as 20 cemented together, or be made unitarily in the shape shown. The line of juncture is shown at 43. The two halves or portions 40, 42 of the dual piece are of opposite colors, e.g., portion 40 white and portion 42 black. Pick-up holes 41, 41 may be provided similarly to the hole 21 in FIGS. 1 and 2.

Figure 3:
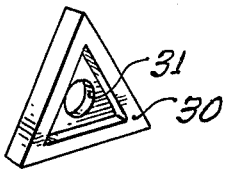
FIG. 3 is a perspective view of a triangular piece.

FIG. 3 shows a triangular piece 30, which may also have a central hole for picking it up, at 31.

Figure 5:
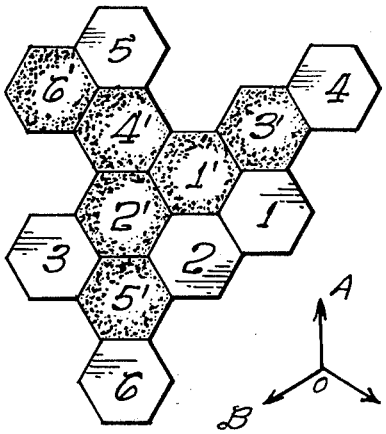
FIG. 5 is a diagrammatic top view of a portion of a game.

FIG. 5 shows semi-diagramatically a small portion of a game played with pieces 20 of the kind shown in FIGS. 1 and 2. The pieces are numbered in the order in which they were played, the plain numerals for White's plays and the primed numerals for Black's. White plays first at 1. Black replies by placing a black piece at 1' White plays at 2; Black replies at 2'. White plays at 3 to block Black from extending the two-piece row 1', 2' in that direction. Black plays at 3', getting a row of three pieces 2'–1'–3'. White blocks him at 4. Black now lays a piece down at 4'. White, who appears to be playing defensively, blocks at 5; Black counters at 5', making another row of three, 4'–2'–5'. White plays at 6 to block this row. Black's counter at 6' makes still another row of three, 1'–4'–6'...

In FIG. 5, the three directions in which rows may be made are indicated by the arrows OA, OB, OC. They are 120° apart, as may be inferred from the nature of hexagons. In the conventional prior game of Go-Bang, rows of pieces may lie, for scoring purposes, only in two orthogonal directions.

Figure 9:
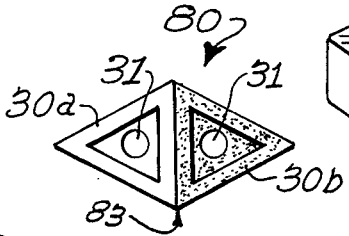
FIG. 9 is a top view of another form of dual piece

Referring to FIG, 3, similar dispositions of pieces in play may be made when the pieces are triangular, as at 30. It will be evident that games such as the above variant of Go-Bang may be played with such pieces; also, FIG. 9, that dual triangular pieces 80 may be used, each in the shape of two such pieces 30a, 30b joined together along a common side 83, analogously to the dual-hexagon pieces of FIG. 4, one half white, the other black, to play the second variant disclosed above. Pick-up holes are shown at 31, FIG. 9

Figure 6:
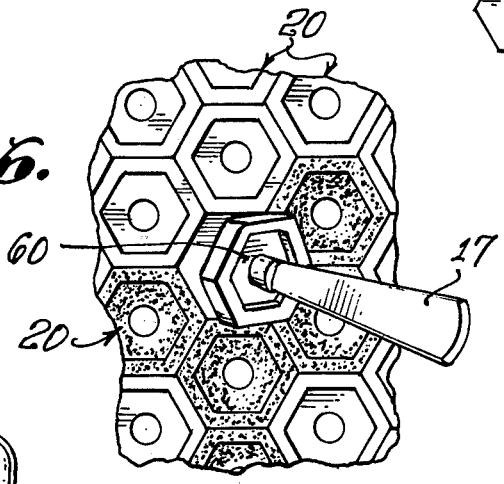
FIG. 6 is a semi-perspective view showing the pick-up means.

FIG. 6 is a semi-perspective illustration of a portion on a game position drawn to show how a piece may be picked up by pick-up means or handle means 17 after all of each players' supply of pieces has been played, and neither player has five in a row, the game being continued after such exhaustion of the original supply of pieces. A player may now pick up a previously-played piece, such as 60, from amid other pieces (indicated generally at 20) and play it in a new position, not shown. To play the piece 60 in the new position, the handle 17 may be used, its tapered end thrust temporarily into the central hole of the piece (as 21, FIGS, 1 and 2), to pull it up out of its close surroundings and carry it away.

Figure 7:
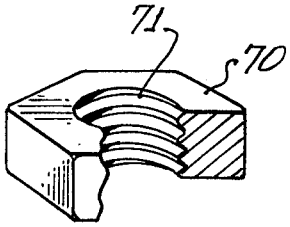
FIG. 7 is a sectional perspective view of a large piece with a finger hole.

FIG. 7 illustrates in section a modification 70 of the piece 20, 30 of FIGS. 1–3. In FIG. 7, the piece indicated generally at 70 is large enough to have a central hole 71 into which a player's finger may be inserted, for the purpose of picking it up. With a piece of such size, handle devices such as shown at 17 are not needed. The central hole 71 may be provided with suitable irregularities or corrugations 72 to keep the player's finger from slipping out of the hole 71, as in a large machine nut.

Figure 8:
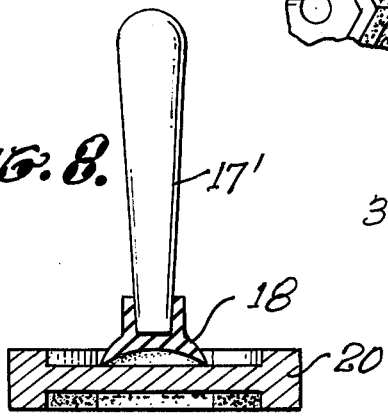
FIG. 8 is a side view, partly cutaway, of a modification of a handle.

FIG. 8 shows a modification 17' of the temporary handle device 17 of FIGS. 2 and 6. The modified handle device 17' is equipped with a suction cup 18 on its lower end. It may be used to pick up game pieces of the invention which lack the central hole 21, 31, 41, of FIGS. 1, 2 and 4. It will be apparent that other pick-up means may be used so long as they do not require reaching around the edges of a surrounded piece-such as small ferrous inserts in the center portions of the pieces and a suitable permanent magnetic structure in the end of a pick-up handle.

The tangible movable objects used in playing such games as checkers, chess, Go, dominoes, etc. have been called by different names: pieces, counters, stones, tiles, men. Herein they are called pieces.

I claim:

1. Apparatus for playing a variant of the game of Go, comprising:

a plain unmarked playing surface;

a set of pieces playable on said surface and all of the same shape and size, each said piece being shaped substantially as a short polygonal prism, the shape of said prism permitting a plurality of pieces to form a mosaic wherein no vertex of one prism lies on a side of another;

end surface portions of each said piece being of one of two different colors but bearing no other distinctive markings;

pick-up means in the end surface portion of each said piece, and a pick-up tool engageable with any of said means to lift a piece axially upward out of said mosaic;

the section of said prism being in the shape of two regular polygons joined along a common side to define a dual piece of two halves, each said half being of a different one of said two colors, said pick-up means being provided in the central portion of each said half; and said two regular polygons being hexagons.

2. Apparatus for playing a variant of the game of Go, comprising:

a plain unmarked playing surface;

a set of pieces playable on said surface and all of the same shape and size, each said piece being shaped substantially as a short polygonal prism, the shape of said prism permitting a plurality of pieces to form a mosaic wherein no vertex of one prism lies on a side of another;

end surface portions of each said piece being of one of two different colors but bearing no other distinctive markings;

pick-up means in the end surface portion of each said piece, and a pick-up tool engageable with any of said means to lift a piece axially upward out of said mosaic;

the section of said prism being in the shape of two regular polygons joined along a common side to define a dual piece of two halves, each side half being of a different one of said two colors, said pick-up means being provided in the central portion of each said half; and said two regular polygons being equilateral triangles, their joinder forming a rhomb.

* * * * *